US005717182A

United States Patent [19]

Mina et al.

[11] Patent Number: 5,717,182

[45] Date of Patent: Feb. 10, 1998

[54] HIGH AMPERAGE DISCONNECT SWITCH

[75] Inventors: Nabil L. Mina, Roselle; Garrett S. Yarbrough, Chicago, both of Ill.

[73] Assignee: Appleton Electric Company, Chicago, Ill.

[21] Appl. No.: 672,675

[22] Filed: Jun. 28, 1996

[51] Int. Cl.[6] ..... H01H 33/12

[52] U.S. Cl. ..... 218/12

[58] Field of Search ..... 218/8, 12, 14, 218/17, 19, 45, 67, 155, 156

[56] References Cited

U.S. PATENT DOCUMENTS

| | | | |
|---|---|---|---|
| 2,239,031 | 4/1941 | Bierenfeld et al. . | |
| 4,001,743 | 1/1977 | Arnhold . | |
| 4,233,482 | 11/1980 | DiMarco et al. | 200/255 |
| 4,514,606 | 4/1985 | Veverka | 218/12 |
| 5,225,642 | 7/1993 | Yamamoto et al. | 218/143 |

OTHER PUBLICATIONS

A Working Manual on Molded Case Circuit Breakers, Fourth Ed., Westinghouse Elec. Co., pp. 106–108.

Slepian, J.; Strom, A.P. "Arcs In Low-Voltage A.C. Networks", pp. 847–853; Sep. 1931.

Slepian, J. "Theory of the Deion Circuit-Breaker", pp. 523–527; Apr., 1929.

Slepian, J. "Extinction of an A–C Arc", pp. 1398–1408.

*Primary Examiner*—Matthew V. Nguyen

*Attorney, Agent, or Firm*—Jones, Day, Reavis & Pogue

[57] ABSTRACT

A pair of fixed contacts is associated with a pair of movable contacts. All of the contacts have circular contact faces. A U-shaped stainless steel arc shield is provided adjacent each set of movable and fixed contacts. The semi-circular bight portion of the arc shield forms part of an imaginary circle having its center concentric with the centers of the contacts. Thus, the outer arcuate portions of the contacts are in constant spaced relationship with the arcuate portion of the adjacent arc shield. The actuator for the contacts provides for sequential opening of the sets of movable and fixed contacts.

18 Claims, 7 Drawing Sheets

60
62
64
66
70
81
82
48
X
Y

HIGH AMPERAGE DISCONNECT SWITCH

BACKGROUND OF THE INVENTION

The present invention relates generally to improvements in molded case disconnect switches. Disconnect switches are typically supplied with current in an amperage range of around 100 to 200 amps.

A disconnect switch is to be distinguished from a circuit interrupter. A disconnect switch has an external handle which is manually operated to break the connection between the power source and the electrical system. Unlike a circuit interrupter, a disconnect switch does not have means to open the circuit automatically and break the connection if there is a current overload in the electrical system. A disconnect switch must be used in conjunction with a circuit breaker if there is a requirement that the electrical system must be tripped automatically.

As is well known to those skilled in the art, as switch contacts separate, an arc is formed in the gap. The initial arc voltage is about 40 volts. Power (arc voltage multiplied by instantaneous current) dissipated in the arc heats the arc, causing it to expand. Initial arc expansion is determined by the diameter of the contacts. If the arc is not extinguished, it will expand until it encounters the switch case material where it will burn off some of the case material helping to cool and thus extinguish the arc. However, the arc will erode and melt the switch case.

SUMMARY OF THE INVENTION

A principal aspect of the present invention resides in a stainless steel arc shield which combines three circuit interruption functions that in previous switch and circuit breaker designs have been performed by separate hardware, namely: (1) the arc shield provides a significantly stronger magnetic field that serves to drive the arc off the contact points; (2) the arc shield acts to cool and deionize the arc when the arc comes into contact with the arc shield; and (3) the arc shield breaks the single arc into two shorter arcs, one between the fixed contact and the arc shield and the other between the movable contact and the arc shield. The creation of the two shorter arcs results in a higher stand-off voltage to prevent reignition of the arc when the circuit voltage reverses. The magnetic field generated by the arc shield drives the arc off the contact points, saving erosion on the points, and onto the shield where (1) the arc is cooled as it comes into contact with the arc shield and (2) it splits into the two shorter arcs.

The present invention also includes the provision of the new and improved actuator for sequentially separating the contacts. These and other objects and advantages of the invention will become apparent from the following specification disclosing a preferred embodiment.

Figure 17:
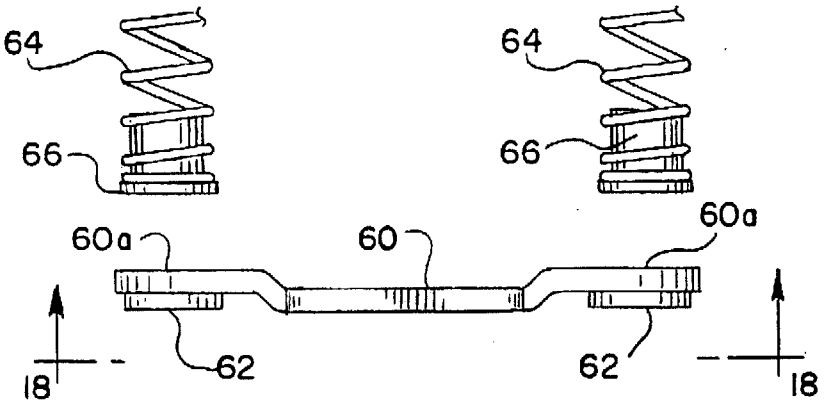
Figure 18:
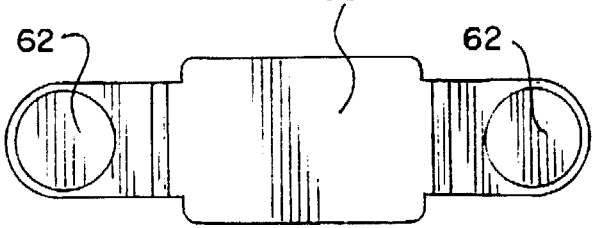
Figure 16:
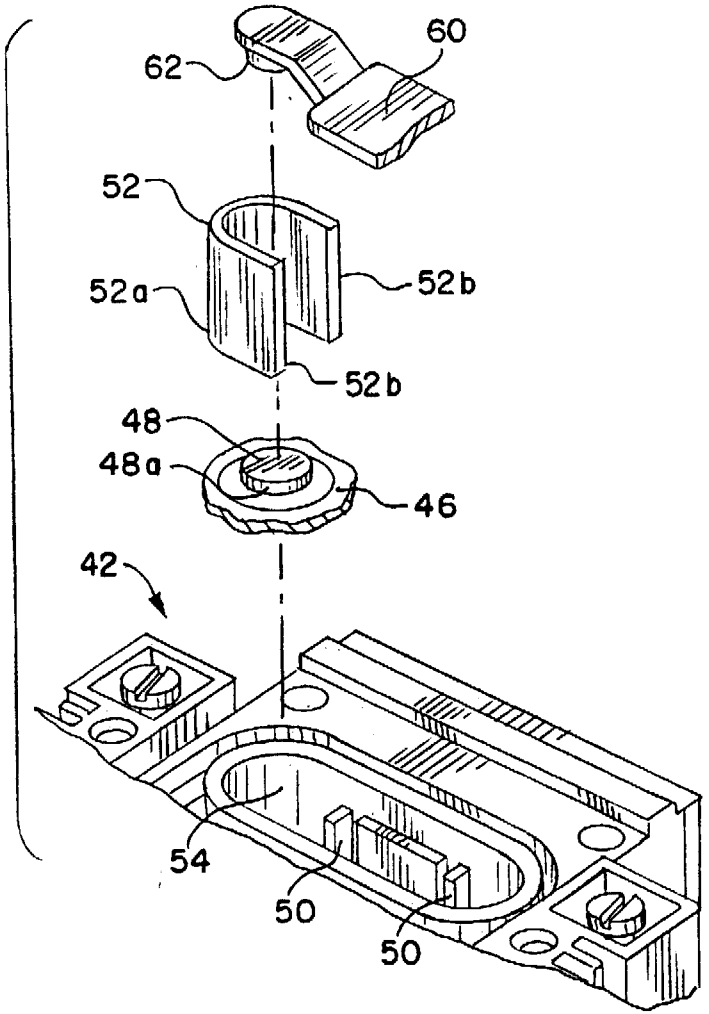

FIGS. **15*a*–15*h*** are sequential sectional views showing operation of the rotor for disengaging the movable contacts from the fixed contacts;

FIG. 16 is an enlarged, exploded, isometric view showing the fixed and movable contacts and the U-shaped arc shield;

FIG. 17 is an enlarged view of the bridge member supporting the movable contacts; and FIG. 18 is a view taken along the line 18—18 of FIG. 17.

DESCRIPTION OF A PREFERRED EMBODIMENT

Referring particularly to FIGS. 1–5, the disconnect switch of the present invention, generally designated 10, includes an enclosure in the form of a main housing, generally designated 12, and a detachable cover plate, generally designated 14. These housing parts may be formed of a suitable thermoplastic material, such as Ryton R-7 available from Phillips Petroleum Company.

The cover 14 is removably secured to the main housing 12 by a plurality of fasteners 15. The cover 14 has an elongated opening 16 (FIG. 2) receiving a vent plate 18. The vent plate is made of porous sintered bronze available from Arrow Pneumatic, Inc. The vent plate, which in a preferred embodiment is one-quarter inches in thickness, has a porosity of 26–51 microns and is molded into the thermoplastic switch cover 14. The vent plate is exposed both to the interior of the switch and to the ambient air for venting contaminated air in the switch produced during arcing; the vent plate 18 serves to bring in ambient air to cool the arcs. The vent plate 18 is located above the fixed and movable contacts. Thus, when warm ionized air travels upwardly, the air travels in the direction of the plate allowing the air to quickly leave the housing without exacerbating the conditions within each cell. The cover 14 also includes six openings 20 to permit access to screw terminals 22.

Figure 3:
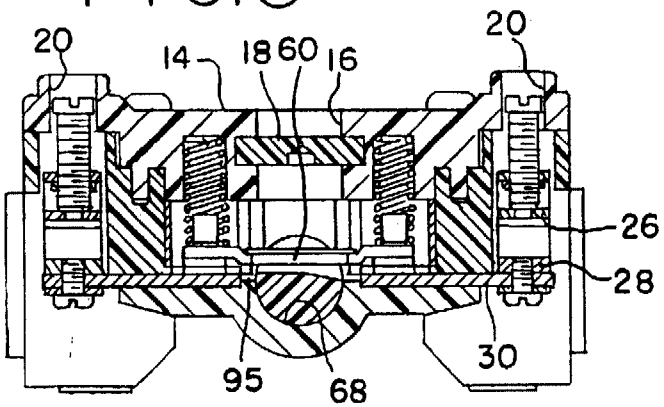
FIG. 3 is a section taken along the line 3—3 of FIG. 2.
Figure 5:
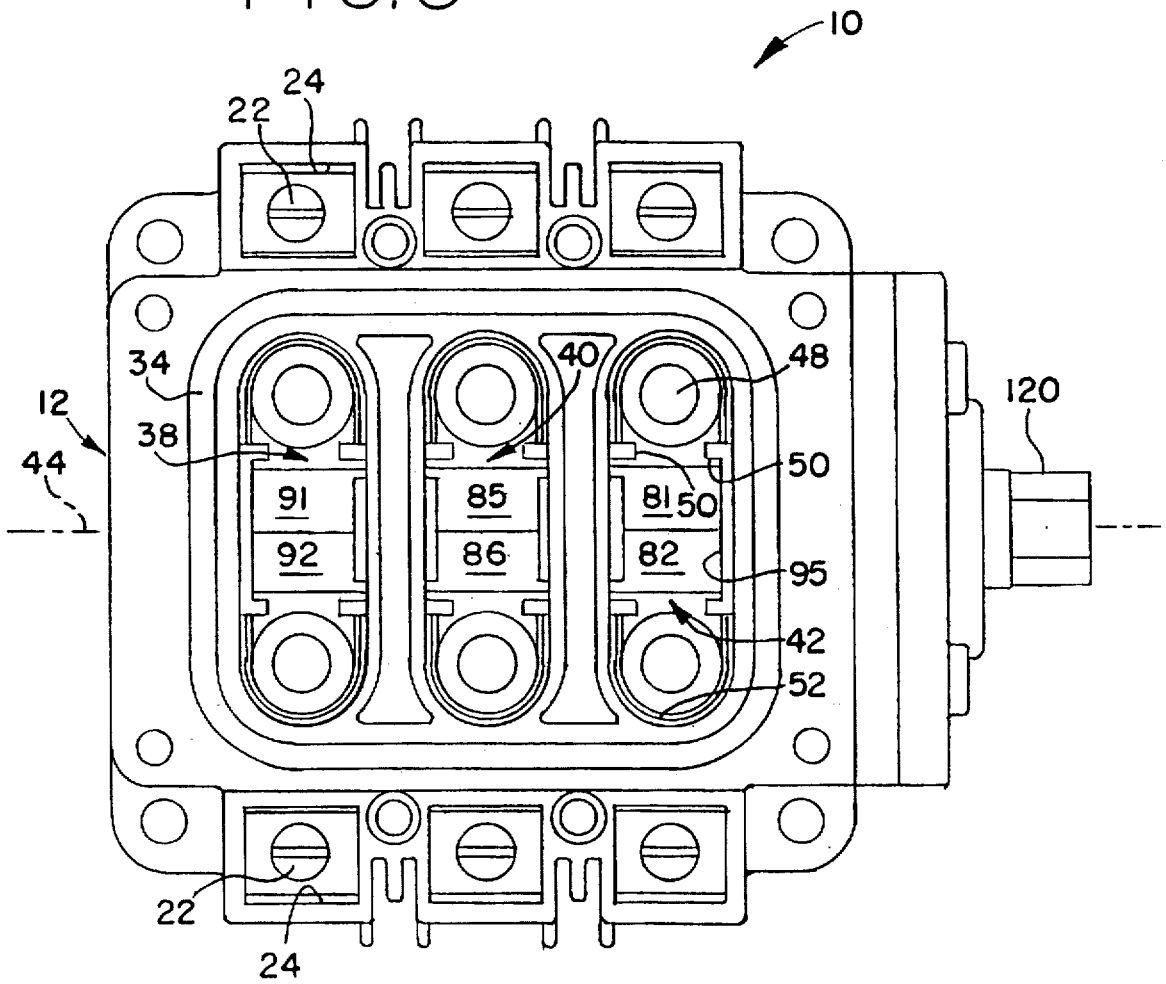
FIG. 5 if an enlarged top view of the disconnect switch with the cover removed.

Referring to FIG. 5, which shows the cover plate removed, the main housing portion 12 includes six openings 24 for receiving the screw terminals 22. Each screw terminal 22 supports a contact pad 26 (FIG. 3) for clamping the end of an electrical conduit or cable (not shown) to a fixed contact pad 28. Each fixed contact pad 28 is in electrical contact with a contact bar 30 (FIG. 3). As is apparent from the drawings, the embodiment of the disconnect switch shown for purposes of illustration includes six of the terminal screws 22 and associated contact pads for making connection to the ends of six contact cables or conduits.

Still referring to FIG. 5, the main housing 12 includes a generally rectangular, continuous recess 34 adapted to receive a correspondingly shaped rib (not shown) formed on the underside of the cover plate 14. The main housing member 12 includes three racetrack shaped arc chambers or cells, generally designated 38, 40 and 42. Since all three chambers are of identical construction, only one will be described in detail. Since each racetrack shaped chamber is symmetrical with respect to the longitudinal central axis 44 (FIG. 5) of the disconnect switch, it will be necessary to describe only one-half of one of the arc chambers.

Referring particularly to FIGS. 5 and 16, the arc chamber 42 includes a base or floor 46 supporting a pair of disklike fixed contacts 48. Each of these contacts is preferably formed from silver cadmium oxide and has a circular contact face. The faces of all of the fixed contacts 48 are substantially coplanar. It will be understood that each contact 48 is in electrical communication with one of the contact bars 30.

The cell 42 includes a pair of parallel opposed ribs 50. A U-shaped arc shield 52, made of stainless steel, is received in each end of each of the racetrack shaped cells. Arc shield 52 includes a bight portion 52*a* joining with planar distal leg portions 52*b*(FIG. 16). The ends of the leg portions 52*b* abut the sides of the ribs 50 for snugly maintaining the arc shield in the end of the raceway. To this end, the arc shield is dimensioned such that it will be tightly received within the raceway with its outer surface in substantial co-extensive contact with the inner wall 54 of the racetrack shaped chamber.

The semi-circular bight portion 52*a* of the arc shield forms part of an imaginary circle having its center concentric with the center of the contact 48. Thus, an outer arcuate portion 48*b* of each contact 48 is in constant spaced relationship with the arcuate or bight portion 52*a* of the adjacent arc shield 52. It will be apparent that the contacts 48 constitute the fixed contacts of the disconnect switch.

Turning now to a description of the movable contacts, attention is invited in particular to FIGS. 17–18. Each racetrack shaped cell receives a copper bridge 60 mounting a pair of disk-like contacts 62. The movable contacts are preferably made of silver cadmium oxide. The bridge 60 includes coplanar abutment surfaces 60a at its ends and on the side thereof opposite the side supporting the contacts 62. The contacts 62 have substantially coplanar circular contact faces. The spacing between the movable contacts 62 is substantially the same as the spacing between the fixed contacts 48.

The cover plate 14 suitably mounts three pairs of depending coil springs 64, each pair arranged to be received within one of the cells 38, 40 and 42. Referring to FIG. 17, each coil spring 64 mounts at its lower end a guide button or pad 66, preferably made of dieletric material, such as nylon. The springs are positioned such that the guide pads 66 will engage the abutment surfaces 60*a* on the bridge for urging the movable contacts 62 into engagement with the fixed contacts 48.

When the disconnect switch is in its "on" or "closed" position, movable contacts 62 will be held into engagement with the fixed contacts 48 by the coil springs 64. The diameters of the movable contacts 62 are preferably substantially the same as the diameters of the fixed contacts 48. The centers of the disk-like movable contacts are concentric with the centers of the disk-like fixed contacts 48 when the movable contacts are in engagement with the fixed contacts. Thus, arcuate portions of the movable contacts are in constant spaced relationship with the bight portions 52*a* of the U-shaped arc shields.

Figure 6:
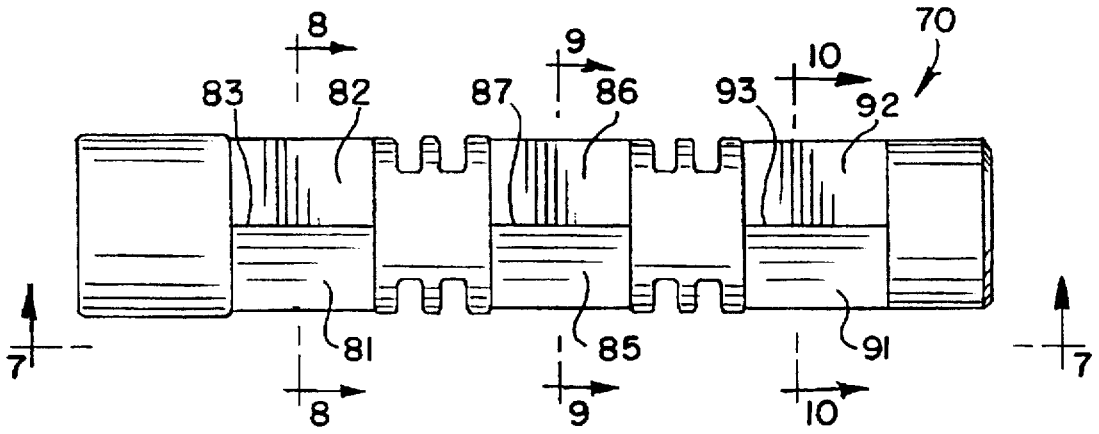
FIG. 6 is an enlarged top view of the rotor.
Figure 7:
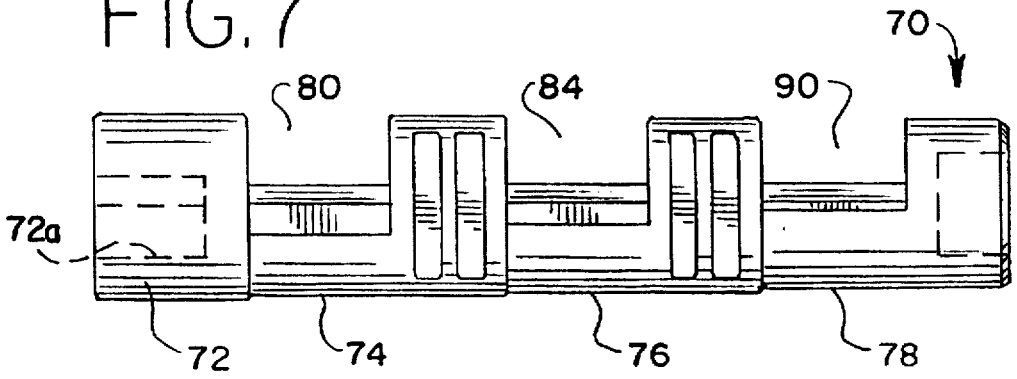
FIG. 7 is an elevational view taken along the line 7—7 of FIG. 6.
Figure 8:
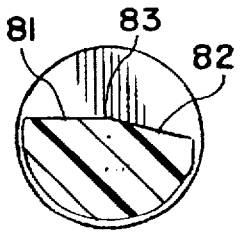
FIG. 8 is a section taken along the line 8—8 of FIG. 6.
Figure 9:
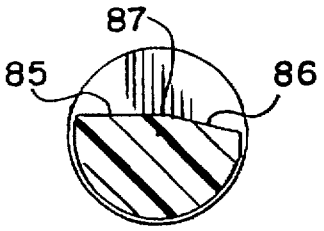
FIG. 9 is a section taken along the line 9—9 of FIG. 6.
Figure 10:
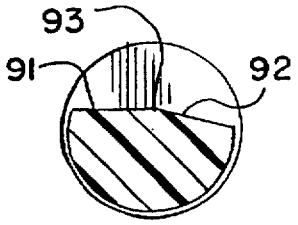
FIG. 10 is a section taken along the line 10—10 of FIG. 6.
Figure 11:
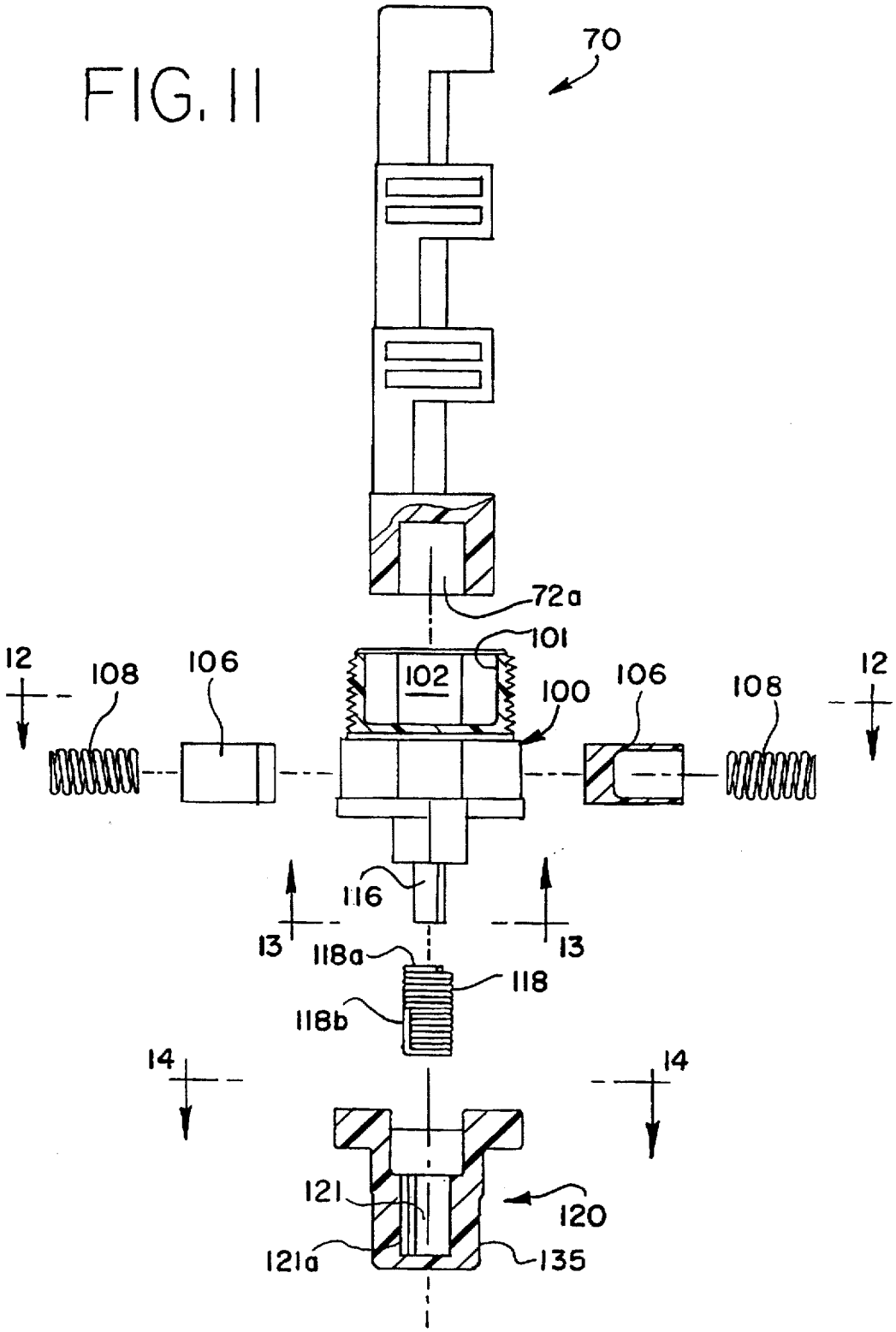
FIG. 11 is an exploded view showing the rotor and actuating mechanism therefor.
Figure 12:
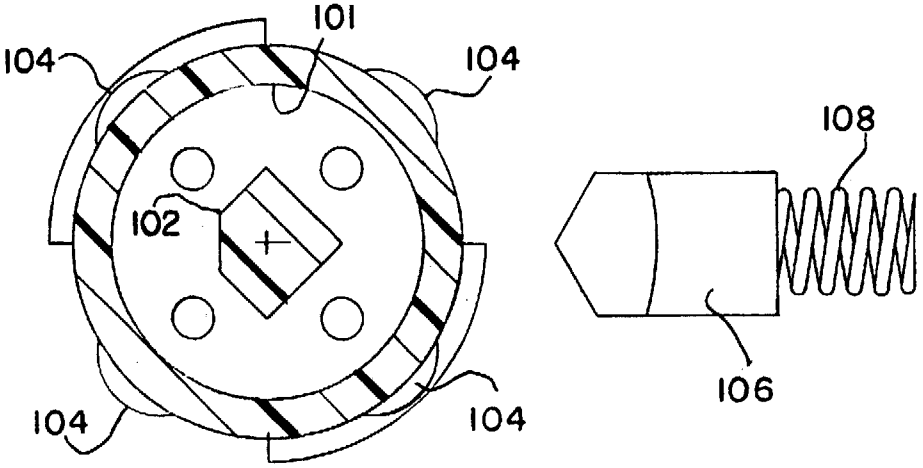
FIG. 12 is an enlarged section taken along the line 12—12 of FIG. 11.

The main housing portion 12 includes a central bore 68 (FIGS. 3 and 4) rotatably receiving an actuating rotor, generally designated 70, and best seen in FIGS. 6 and 7. The rotor 70 is essentially circular in cross-section and is formed by integral sections 72, 74, 76 and 78. Progressing from left to right as shown in FIGS. 6 and 7, each section is of a reduced diameter from the adjacent rotor section thereby defining a telescope-like shape which facilitates mounting of the rotor within the housing section 12.

Section 72 of the rotor is cylindrical and includes a square in cross-section bore 72*a*. The section 74 of the rotor includes a diametrically disposed slot 80; this slot defines radially disposed planar surfaces 81 and 82 joining to form a ridge or peak 83. Similarly, the rotor section 76 includes a diametrically disposed slot 84 forming radially disposed planar surfaces 85 and 86 joining to form a peak or ridge 87. Finally, the rotor section 78 includes a slot 90 forming radially disposed planar surfaces 91 and 92 joining at a ridge or peak 93. The peaks or ridges 83, 87 and 93 are collinear. The faces 81, 85 and 91 are coplanar as is also the case with the faces 82, 86 and 92. The sizes of the various planar faces differ slightly in the radial direction due to the step-like configuration of the rotor 70 as seen in FIG. 7 and as referred to above.

Figure 2:
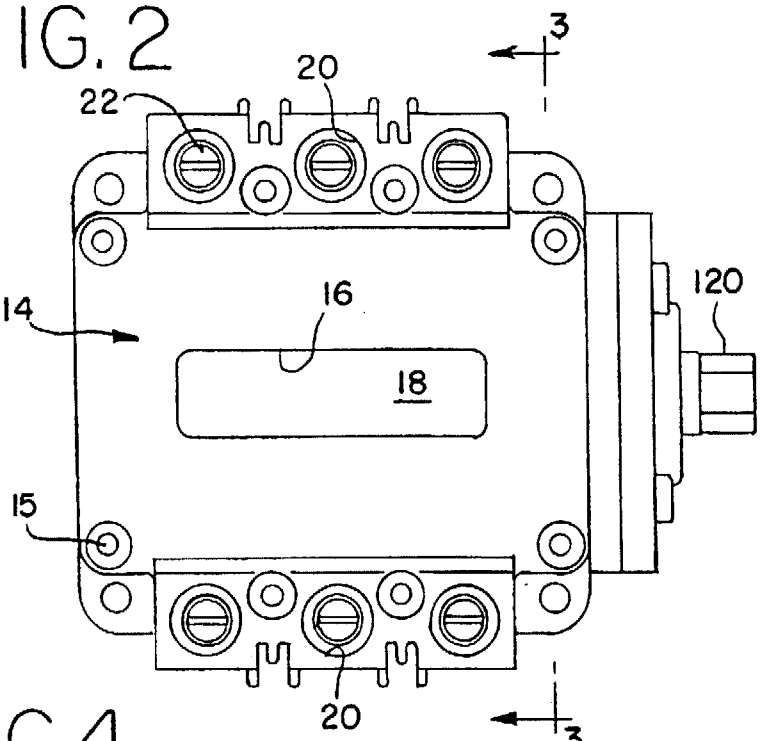
FIG. 2 is a top plan view of the disconnect switch.
Figure 4:
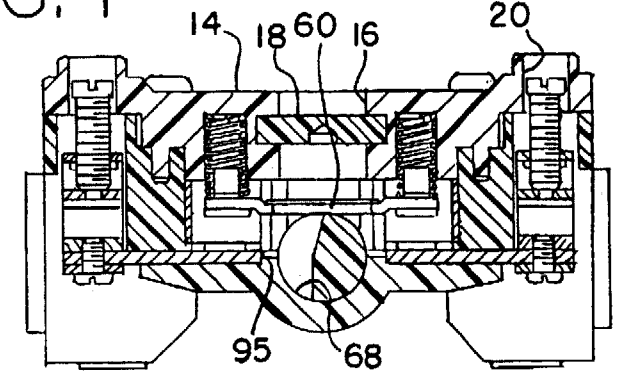
FIG. 4 is a section similar to FIG. 3 but showing the rotor and the movable contacts in a different position.

Referring to FIGS. 3–5, it is seen that the floor of each of the racetrack shaped cells 38, 40 and 42 includes an opening 95 to expose the adjacent actuating faces on the rotor. Thus, upon rotation of the actuating rotor, the various faces 81, 82, 85, 86, 91 and 92 will enter the racetrack shaped arc chambers or cells for actuating the movable contacts as will be explained below.

The actuating mechanism for the rotor 70 can be understood by reference to FIGS. 11–14. This mechanism includes a body part 100 which is suitably mounted for rotation within the housing section 12. The part 100 has an annular recess 101 containing a stud 102 which is generally square in cross-section and which is adapted to be received within the square in cross-section opening 72*a* in the end of the rotor 70. Thus, rotation of the part 100 will cause corresponding rotation of the rotor.

The part 100 has four, radially disposed, equally spaced detent lobes 104 (FIG. 12) defining open spaces therebetween. A pair of oppositely disposed detents 106 are biased by springs 108 (all suitably contained within the housing 12) and are normally received within the spaces between the lobes. The detents serve for releasably holding the member 100, and consequently the rotor 70, in predetermined arcuate positions. In the embodiment shown for purposes of illustration, the member 100 and rotor 70 are mounted for movement back and forth through a 90-degree arc for establishing the "on" and "off" positions of the switch. Suitable stop means (not shown) are provided for limiting the amount of rotation of the member 100.

Figure 13:
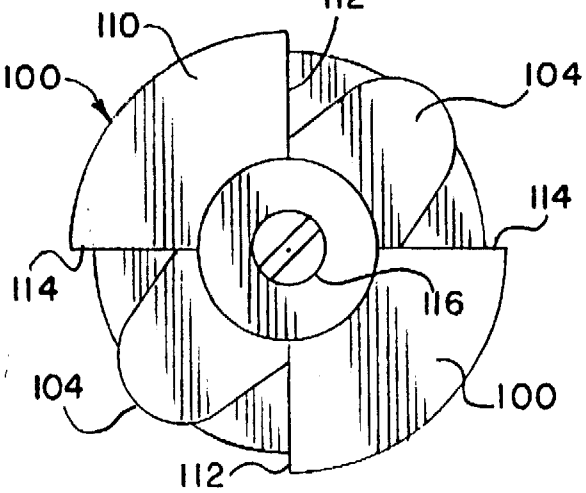
FIG. 13 is an enlarged elevational view taken along the line 13—13 of FIG. 11.

As noted in FIG. 13, the member 100 has a pair of oppositely diametrically disposed pie-shaped segments 110 defining radially and axially disposed walls 112 and 114. The member 100 further includes an integral cylindrical formation 116 which is slotted for receiving one end 118*a* (FIG. 11) of a coil spring 118.

The actuator further includes a member, generally designated 120, which has a central bore 121 for receiving the coil spring 118. The bore 121 includes an axial recess 121*a* for receiving the end 118*b* of the spring 118.

Figure 14:
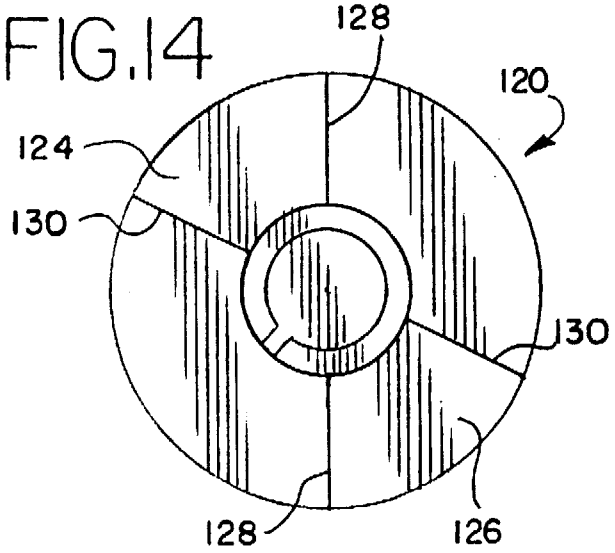
FIG. 14 is an enlarged elevational view taken along the line 14—14 of FIG. 11.

As seen in FIG. 14, the member 120 includes a pair of diametrically disposed pie-shaped sections 124, 126 defining radially and axially extending walls 128 and 130. When the members 100 and 120 are in assembled condition capturing the coil spring 118, the surfaces 130 will be disposed for abutting engagement with the surfaces 114. Similarly, the surfaces 128 on the member 120 will be in position for abutting engagement with the surfaces 112 on the member 100. The spring 118 serves to maintain surfaces 130 in spaced relationship with the surfaces 114. When the member 120 is rotated counterclockwise from the "on" to the "off" position (see FIG. 1), the surfaces 130 will be brought into engagement with the surfaces 114 for causing rotation of the member 100 and in turn the rotor 70. Thus, there is a lost-motion connection between the actuating member 120 and the rotor 70. The member 120 includes a multi-sided external configuration 135 facilitating attachment of a handle for manual operation of the disconnect switch.

Figure 1:
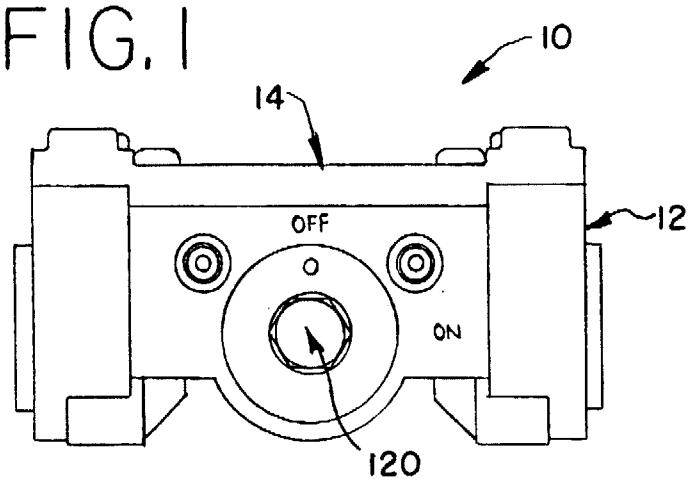
FIG. 1 is an elevational view of the disconnect switch.
Figures 15A, 15B, 15C, 15D, 15E, 15F, 15G, 15H:
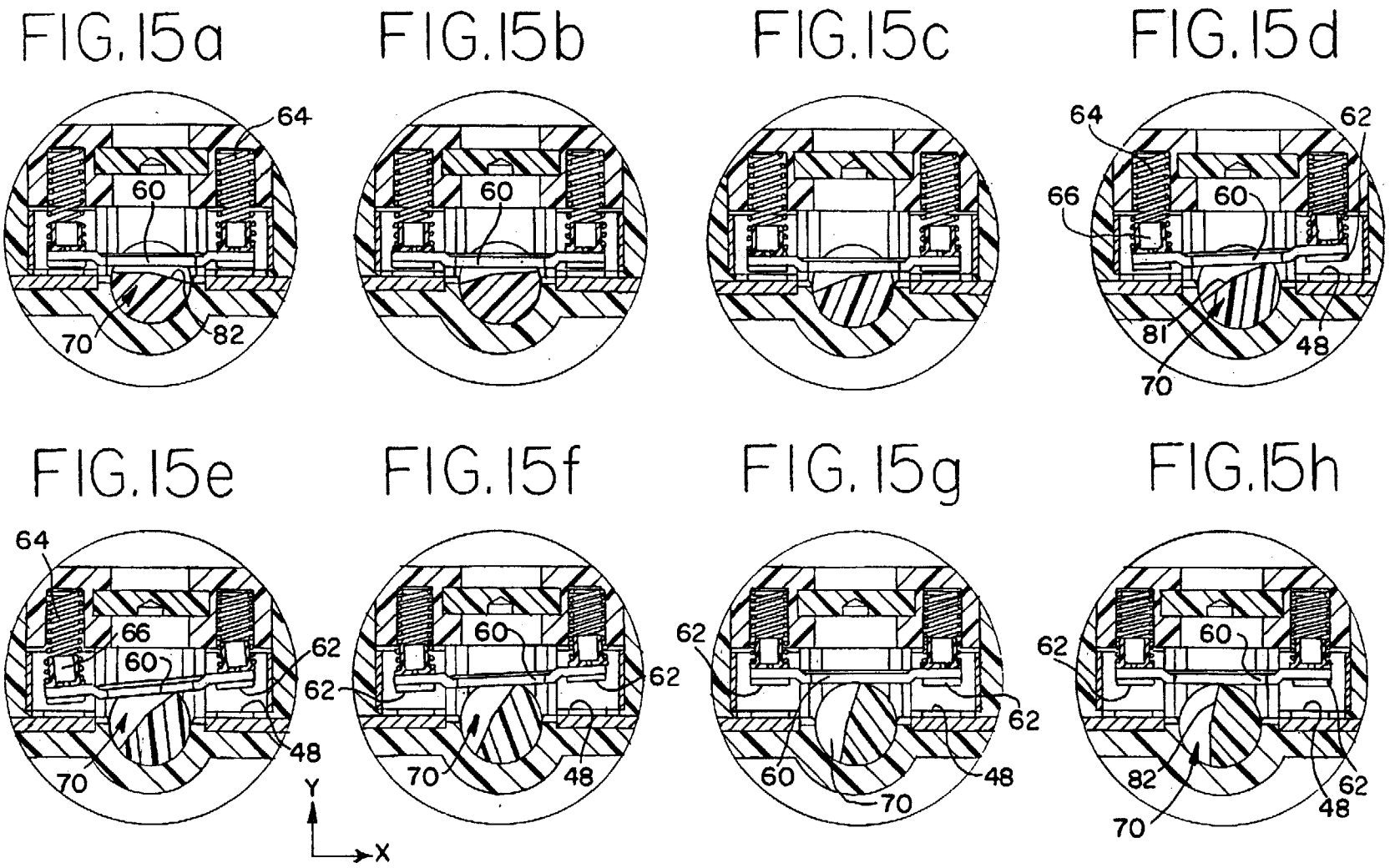

The operation of the disconnect switch of the present invention can best be understood by reference to FIG. 15. Referring to FIG. 15*a*, which shows the switch in the "on" position, the coil springs 64 function to maintain the movable contacts 62 in engagement with respective fixed contacts 48. When it is desired to open the contacts, i.e., rotate the rotor 70 to the "off" position, the actuator member 120 will be rotated in a counterclockwise direction as seen in FIG. 1. By virtue of the lost-motion connection between the member 120 and the actuator member 100, the actuator member 120 will be permitted to accelerate and will cause rapid rotation of the member 100, and consequently the rotor 70, when the faces 130 are brought into engagement with the faces 114. The rotor 70 will commence its counterclockwise rotation as shown in FIGS. 15*b* and 15*c*. As the rotor continues to rotate in a counterclockwise direction, the faces 82, 86 and 92 will eventually be brought into contact with the underside of the bridges 60. Since the faces 82, 86 and 92 are in spaced relationship from the bridges 60 when the switch is in its "on" position as shown in FIG. 15*a*, another lost-motion connection is established between the rotor and the bridges upon counterclockwise rotation of the rotor. Thus, by reason of the lost-motion between the actuator member 120 and the member 100 and the lost-motion between the faces 82, 86, 92 and the bridges, the faces 82, 86 and 92 will be brought into sharp and rapid contact with the bridges for fast separation of the movable contacts.

As is apparent from FIG. 15*d*, outer portions of the faces 82, 86 and 92 engage each bridge nearer one of the movable contacts than the other movable contact; consequently, one set of movable and fixed contacts in each arc chamber will be separated prior to separation of the other movable contact and its associated fixed contact. This feature tends to minimize arcing.

FIGS. 15*e*–15*h* progressively show the movement of the movable contacts as the actuator is moved through intermediate positions from the "on" position to the full "off" position in which case each pair of movable contacts is completely separated from the associated pair of fixed contacts.

Upon opening of the contacts, the coil springs 64 allow separation of the movable contacts 62 from the fixed contacts 48. This movement is primarily along the Y axis as shown in FIG. 15. However, as noted in FIG. 15*e*, for example, the coil springs also permit translational movement of the bridge and movable contacts in the X direction. When the actuator is moved from the "off" position to the "on" position, the sequence of events will be the reverse of those shown in FIGS. 15*a*–15*h*.

It will be apparent from FIGS. 15*a*–15*h* that the vertical extent of the arc shields 52 is such that the movable contacts will always remain within the space created by the arc shields 52. Electro-magnetic analysis has shown that the effects of the stainless steel U-shaped arc shields provide a strong magnetic field that drives the arc column away from the contact points and toward the shield itself. Arc burning occurs predominantly along the surface of the shield as there is little or no thermal loading on the contact points themselves. The arc shield has the ability to split the arc into two smaller burning arcs, one between the fixed contact terminal and shield and the other between the shield and the movable contact on the bridge. By splitting the arc, the shield is able to cool quickly and deionize the arc and significantly slow down the process of contact erosion or melting of the shield. The arc shield also protects the contact terminals and thermoplastic enclosure from erosion by drawing the arc towards itself. Since outer arcuate portions of the fixed and movable contacts are in constant spaced relationship with the bight portions 52*a* of the arc shields, the arcs will be drawn to the arc shields at random locations thus minimizing erosion of both the contacts and the arc shields.

While we have shown and described a preferred embodiment in accordance with the present invention, it is to be understood that the invention is not limited to the embodiment shown but is susceptible to numerous changes and modifications as known to a person skilled in the art. Therefore, we do not wish to be limited to the details shown and described herein but intend to cover all such changes and modifications which are within the scope of the following claims.

What is claimed is:

1. A disconnect switch comprising:

(a) a housing made of dielectric material;

(b) at least one fixed contact supported by the housing and having a contact face defining a perimeter a substantial portion of which is semi-circular in shape;

(c) at least one movable contact supported by the housing and having a contact face defining a perimeter a substantial portion of which is semi-circular in shape;

(d) means supported by the housing for bringing the movable contact face into and out of engagement with the fixed contact face; and (e) a stainless steel arc shield fixedly mounted by the housing in adjacent relationship with the fixed and movable contact faces, said arc shield having a semi-circular portion in constant spaced relationship with the semi-circular portions of the fixed and movable contact faces and having an axial extent such that upon separation of the contact faces the arc will split into two shorter arcs, one between the fixed contact face and the arc shield and the other between the movable contact face and the arc shield.

2. The disconnect switch according to claim 1 wherein said fixed and movable contact each have a circular contact face and wherein said arc shield is of U-shaped configuration having a bight portion defining said semi-circular portion and joining planar distal portions.

3. A disconnect switch comprising:

(a) a housing made of dielectric material;

(b) at least one pair of fixed contacts supported by the housing, each having a contact face defining a perimeter a substantial portion of which is semi-circular in shape;

(c) at least one movable bridge contact supported by the housing, said movable bridge contact having a pair of contact faces with a configuration substantially the same as the configuration of the fixed contact faces;

(d) means supported by the housing for bringing respective ones of the movable contact faces into and out of engagement with the fixed contact faces; and (e) at least one pair of stainless steel arc shields fixedly mounted by the housing in adjacent relationship with respective fixed contact faces, each arc shield having a semi-circular portion in constant spaced relationship with the semi-circular portions of the fixed and movable contact faces and having an axial extent such that upon separation of the fixed and movable contact faces the arc will split into two shorter arcs, one between the fixed contact faces and the arc shield and the other between the movable contact faces and the arc shield.

4. The disconnect switch according to claim 1 wherein each fixed contact has a circular contact face and wherein each arc shield is of U-shaped configuration having a bight portion defined by said semi-circular portion and joining planar distal portions.

5. A disconnect switch comprising:

(a) a housing made of dielectric material;

(b) at least one pair of fixed contacts supported by the housing in spaced relationship with each other, said fixed contacts having respective coplanar contact faces;

(c) at least one pair of movable contacts each having a contact face, a bridge member having first and second opposite faces and supporting said movable contacts on said first face thereof such that the contact faces thereof are co-planar and spaced substantially the same distance as the distance between said fixed contacts;

(d) yieldable means in said housing engaging said bridge member on said second face thereof for urging respective movable contact faces into engagement with said fixed contact faces, said yieldable means permitting movement of said movable contacts away from said fixed contacts along a first axis and for limited movement along a second axis perpendicular to said first axis;

(e) at least one pair of arc shields supported by said housing in adjacent respective relationship with each pair of fixed and movable contact faces;

(f) actuating means supported by the housing for moving said movable contact faces into and out of engagement with said fixed contact faces, said actuating means including an actuator member movable back and forth between an on position, an off position and an intermediate position, said yieldable means serving to hold said movable contact faces into engagement with said fixed contact faces when said actuator member is in its on position, said actuator member having a formation for engaging said bridge member on said first face thereof at a location nearer one of said movable contact faces than the other movable contact face when said actuator member is in its intermediate position such that said one movable contact face separates from the corresponding fixed contact face while said yieldable means continue to urge the other movable contact face into engagement with its corresponding fixed contact face, said actuator member in its off position serving to move the bridge member such that both movable contact faces are separated from their corresponding fixed contact faces.

6. The disconnect switch according to claim 5 wherein said fixed and movable contact faces are substantially circular in configuration and wherein said arc shields are of U-shaped configuration, each having a bight portion joining planar distal portions, said bight portion defining an imaginary circle concentric with the adjacent fixed contact face, and each arc shield having an axial extent such that upon separation of the contact faces the arc will split into two shorter arcs, one between the fixed contact faces and the arc shield and the other between the movable contact faces and the arc shield.

7. The disconnect switch according to claim 5 wherein said formation is in spaced relationship with said bridge member when said actuator member is in its on position thereby permitting said actuator member to accelerate prior to engagement of said formation with said bridge member when the actuator member is moved toward the off position.

8. The disconnect switch according to claim 5 wherein said arc shields are made of stainless steel.

9. A high amperage disconnect switch comprising:

(a) a housing made of dielectric material;

(b) at least one pair of fixed contacts supported by the housing in spaced relationship with each other, said fixed contacts having respective coplanar contact faces;

(c) at least one bridge bar contained within the housing, said bridge bar having a first face mounting a pair of movable contacts having coplanar contact faces spaced apart approximately the same distance as the distance between said fixed contact faces, said bridge bar having a second opposed face defining a pair of coplanar abutment surfaces spaced apart a distance substantially the same as the distance between said movable contacts;

(d) at least one pair of coil springs, each being supported at one end by the housing, the other end of each spring mounting a pad of dielectric material, said springs serving to urge said pads against respective abutment surfaces on said bridge member for in turn urging said movable contact faces into engagement with respective fixed contact faces;

(e) at least one pair of arc shields supported by said housing in adjacent relationship with respective fixed contacts; and (f) actuating means supported by the housing for moving said movable contact faces into and out of engagement with said fixed contact faces, said actuating means including an actuator member movable back and forth between an on position, an off position and an intermediate position, said spring means serving to hold said movable contact faces into engagement with said fixed contact faces when said actuator member is in its on position, said actuator member having a formation for engaging said first face of the bridge bar at a location nearer one of said movable contact faces than the other movable contact face when said actuator member is in its intermediate position such that said one movable contact face separates from the corresponding fixed contact face while said spring means continue to urge the other movable contact face into engagement with its corresponding fixed contact face, said actuator member in its off position serving to move the bridge bar such that both movable contact faces are separated from the corresponding fixed contact faces.

10. The disconnect switch according to claim 9 wherein said fixed and movable contact faces are substantially circular in configuration and wherein said arc shields are of U-shaped configuration each having a bight portion joining planar distal portions, each such bight portion defining part of an imaginary circle concentric with the adjacent circular contact faces, and each arc shield having an axial extent such that upon separation of the contact faces the arc will split into two shorter arcs, one between the fixed contact faces and the arc shield and the other between the movable contact faces and the arc shield.

11. The disconnect switch according to claim 9 wherein said formation is in spaced relationship with said bridge member when said actuator member is in its on position thereby permitting said actuator member to accelerate prior to engagement of said formation with said bridge member.

12. The disconnect switch according to claim 9 wherein said arc shields are made of stainless steel.

13. The disconnect switch according to claim 5 wherein said actuating means includes:

(a) a manually operated actuator element; and (b) lost-motion means connecting said actuator element with said actuator member.

14. The disconnect switch according to claim 9 wherein said actuating means includes:

(a) a manually operated actuator element; and (b) lost-motion means connecting said actuator element with said actuator member.

15. The disconnect switch according to claim 5 wherein said actuator member is mounted by the housing for rotation between its on and off positions and vice versa.

16. The disconnect switch according to claim 9 wherein said actuator member is mounted by the housing for rotation between its on and off positions and vice versa.

17. The disconnect switch according to claim 5 wherein said actuator member is generally in the form of a cylinder having at least one transversely disposed recess defining at least one generally radially disposed planar surface constituting said formation.

18. The disconnect switch according to claim 9 wherein said actuator member is generally in the form of a cylinder having at least one transversely disposed recess defining at least one generally radially disposed planar surface constituting said formation.

* * * * *